US006270420B1

(12) United States Patent
Lee

(10) Patent No.: US 6,270,420 B1
(45) Date of Patent: Aug. 7, 2001

(54) ORNAMENTAL LIQUID CONTAINER PRODUCING DYNAMIC VIEWS

(76) Inventor: Vincent K. Lee, No. 42, Lane 458, Shen Chung St., Shyn Lin Dist., Taipei (TW)

( * ) Notice: Subject to any disclaimer, the term of this patent is extended or adjusted under 35 U.S.C. 154(b) by 0 days.

(21) Appl. No.: 09/493,612

(22) Filed: Jan. 28, 2000

(51) Int. Cl.[7] ..... A63H 23/08

(52) U.S. Cl. ..... 472/67; 446/267; 40/412; 40/427; 40/430

(58) Field of Search ..... 472/65, 67, 57, 472/137; 40/412, 427, 429, 430; 446/267, 167, 168

(56) References Cited

U.S. PATENT DOCUMENTS 1,454,426 * 5/1923 Clements ..... 40/412
2,615,266 * 10/1952 Wallin et al. ..... 40/430
2,752,725 * 7/1956 Unsworth ..... 446/166
3,071,375 * 1/1963 Moore ..... 472/67

* cited by examiner

*Primary Examiner*—Kien T. Nguyen
(74) *Attorney, Agent, or Firm*—Dougherty & Troxell

(57) ABSTRACT

An ornamental liquid container for creating dynamic views is provided. The container mainly includes a hollow housing divided into top, middle and bottom chambers and a base connected to and separated from the bottom chamber by an elastic and soft diaphragm. The top and the bottom chambers communicate with each other via a hollow tube extended through the middle chamber, so that colored water can be stored in the bottom chamber and move into the top chamber via the hollow tube and clear oil can be stored in the middle chamber and the hollow tube above the colored water. A cam is mounted in the base and rotated by a driving unit to intermittently pat the diaphragm above it, causing the diaphragm to locally project into the bottom chamber and compress the colored water therein to move into the top chamber via the hollow tube and then drips down into the middle chamber to move along a water dispensing member and produce dynamic views in the hollow housing.

3 Claims, 6 Drawing Sheets

ORNAMENTAL LIQUID CONTAINER PRODUCING DYNAMIC VIEWS

BACKGROUND OF THE INVENTION

The rapid development of the commercial and industrial field stimulates people to constantly upgrade their living quality. People's attitude toward an article to be purchased is much more strict than ever before. The article must be reasonably economical in price and absolutely novel and fashionable in structure and function to win a buyer's trust. For an ornamental liquid container that has become a popular interior decoration and must have limited dimensions for holding oil and water therein, it is really uneasy to make such ornamental liquid container distinct in appearance, structurally watertight, and capable of displaying unique and dynamic views in a small space.

SUMMARY OF THE INVENTION

A primary object of the present invention is to provide an ornamental liquid container that employs simple eccentric motion of a cam to intermittently push an elastic and soft diaphragm toward and therefore compress a water chamber of the container, causing water in the chamber to circulate in the container along a predetermined path and create dynamic views.

Another object of the present invention is to provide an ornamental liquid container that employs simple structure to create dynamic views and is therefore economical and practical for use.

A further object of the present invention is to provide an ornamental liquid container, a basic structure of which for creating dynamic views can be associated with differently shaped housing and internal water dispensing member, so that the views displayed in the liquid container is not only dynamic but also changeful.

To achieve the above and other objects, the ornamental liquid container of the present invention mainly includes a hollow housing divided into top, middle and bottom chambers and a base connected to and separated from the bottom chamber by an elastic and soft diaphragm. The top and the bottom chambers communicate with each other via a hollow tube extended through the middle chamber, so that colored water can be stored in the bottom chamber and move into the top chamber via the hollow tube and clear oil can be stored in the middle chamber and the hollow tube above the colored water. A cam is mounted in the base and rotated by a driving means to intermittently pat the diaphragm above it, causing the diaphragm to locally project into the bottom chamber and compress the colored water therein to move into the top chamber via the hollow tube and then drips down into the middle chamber to move along a water dispensing member and produce dynamic views in the hollow housing.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
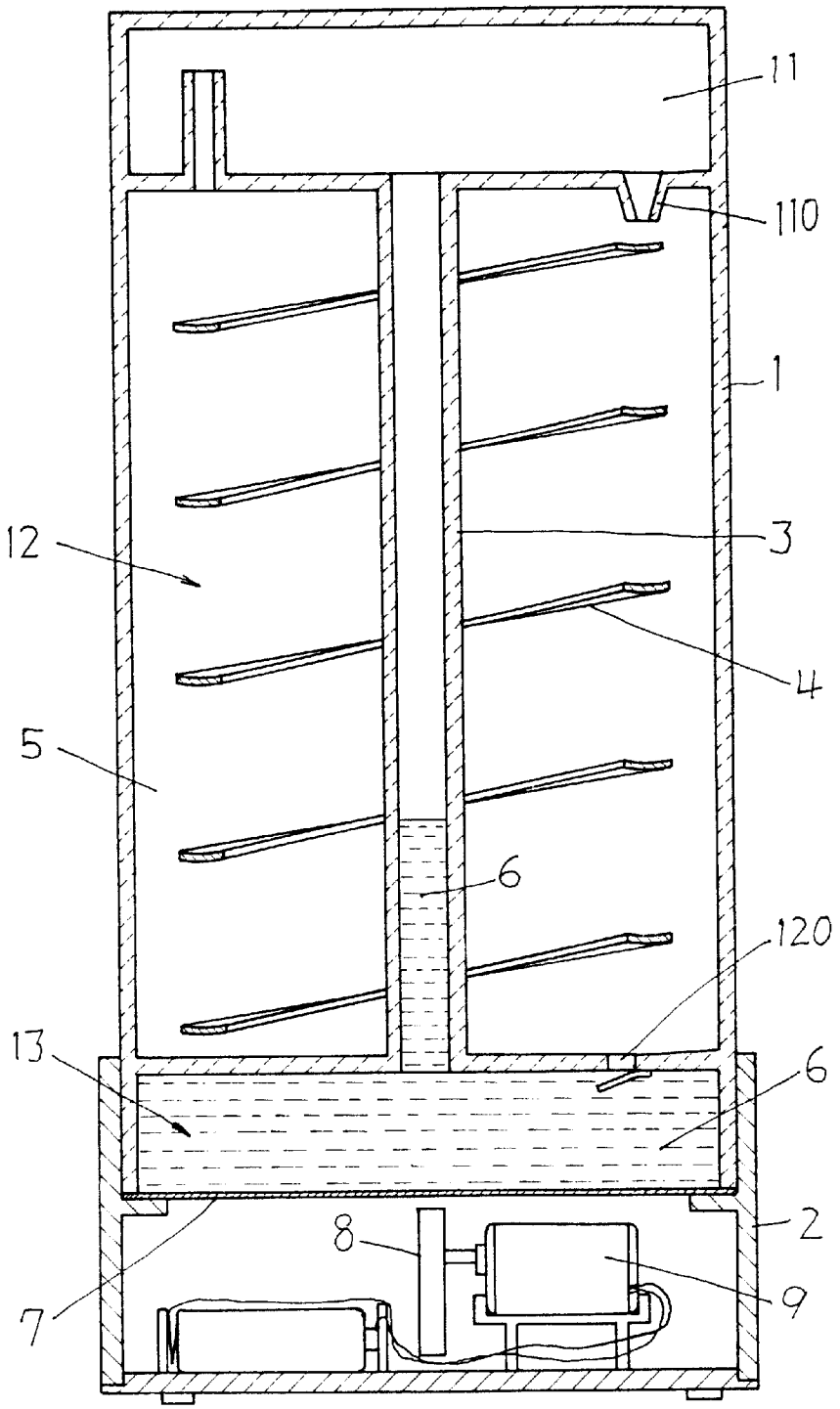
FIG. 1 is a sectional view of an ornamental liquid container according to an embodiment of the present invention showing the structure thereof.

Please refer to FIG. 1 that is a sectional view of an ornamental liquid container according to a first embodiment of the present invention. As shown, the liquid container mainly includes a hollow housing 1 and an open-topped base 2 below the housing 1.

The hollow housing 1 is divided from top to bottom into a top chamber 11, a middle chamber 12, and a bottom chamber 13. The top chamber 11 and the middle chamber 12 are communicable with each other through a first hole 110 provided at a partition plate between the top chamber 11 and the middle chamber 12. The middle chamber 12 and the bottom chamber 13 are communicable with each other via a second hole 120 provided at a partition plate between the middle and the bottom chambers 12, 13. The top chamber 11 and the bottom chamber 13 are communicable via a hollow tube 3 vertically extended through the middle chamber 12 to locate between the top and the bottom chambers. The hollow tube 3 is provided around an outer periphery with a specially designed water dispensing member 4 along which water moves. In this first embodiment, the water dispensing member 4 forms a spiral path in the middle chamber 12 of the housing 1.

The bottom chamber 13 is open-bottomed and connected at a lower end to the open-topped base 2 with a diaphragm 7 made of an elastic and soft material being positioned between the lower end of the bottom chamber 13 and the base 2 in a watertight manner.

The hollow housing 1 is filled with a type of clear oil 5 and a predetermined amount of colored water 6. The colored water 6 is stored in the bottom chamber 13 above the diaphragm 7 with a predetermined level of the colored water 6 in the hollow tube 3 is created. Since the clear oil 5 has a specific gravity smaller than that of water 6, it naturally locates above the water 6 and most part of it is in the middle chamber 12.

In an inner space of the base 2 below the diaphragm 7, there is mounted a driving means 9, such as a motor, a music box module or the like, to which a cam 8 is connected. When the driving means 9 is actuated, it drives the cam 8 to rotate. The cam 8 is so located that when the cam 8 enters an upper dead point thereof, it contacts with the elastic soft diaphragm 7 to locally push the diaphragm 7 toward the bottom chamber 13.

Figure 2:
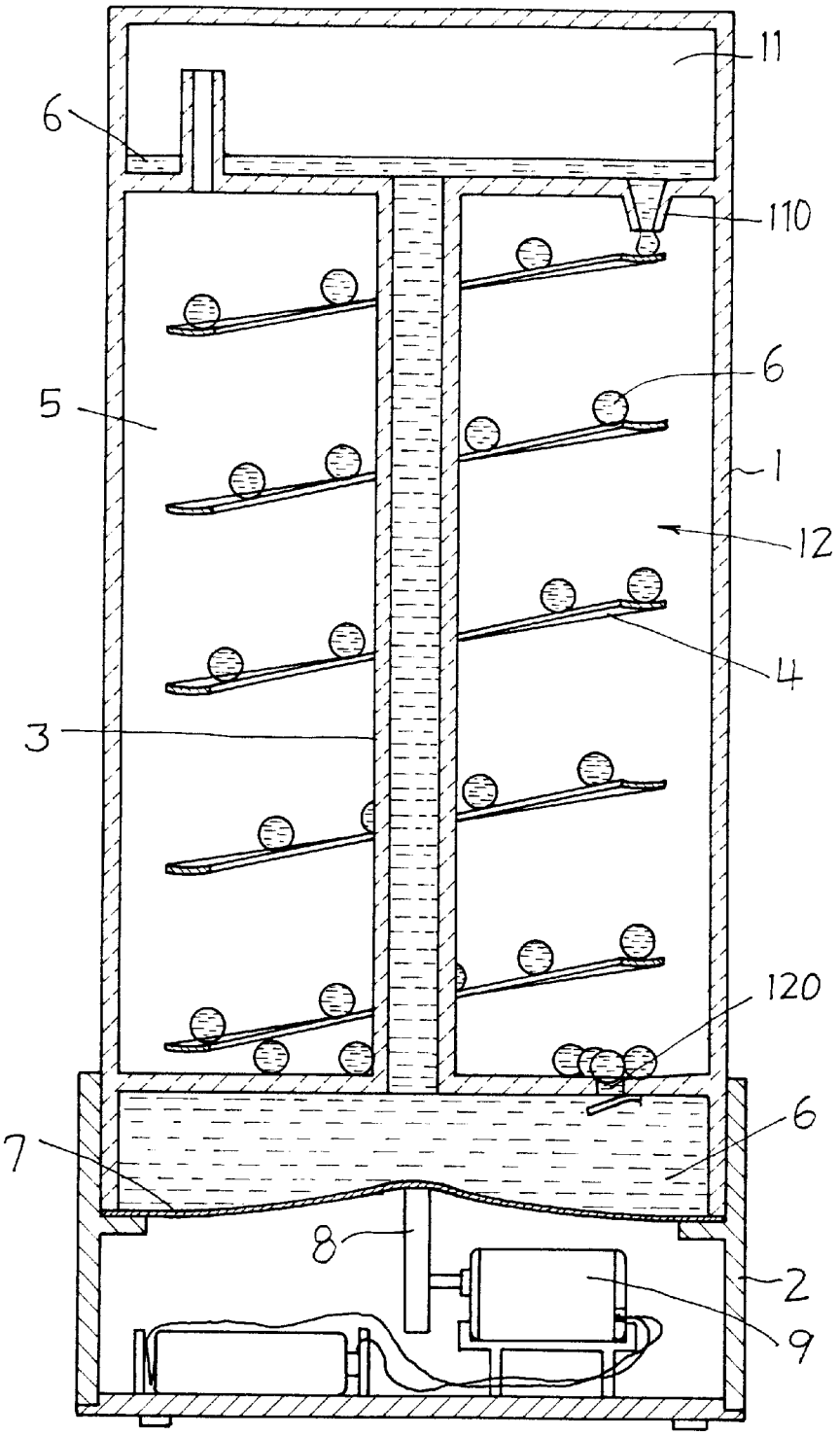
FIG. 2 is another sectional view of the ornamental liquid container of FIG. 1 showing colored water therein is caused to move and produce dynamic views.
Figure 3:
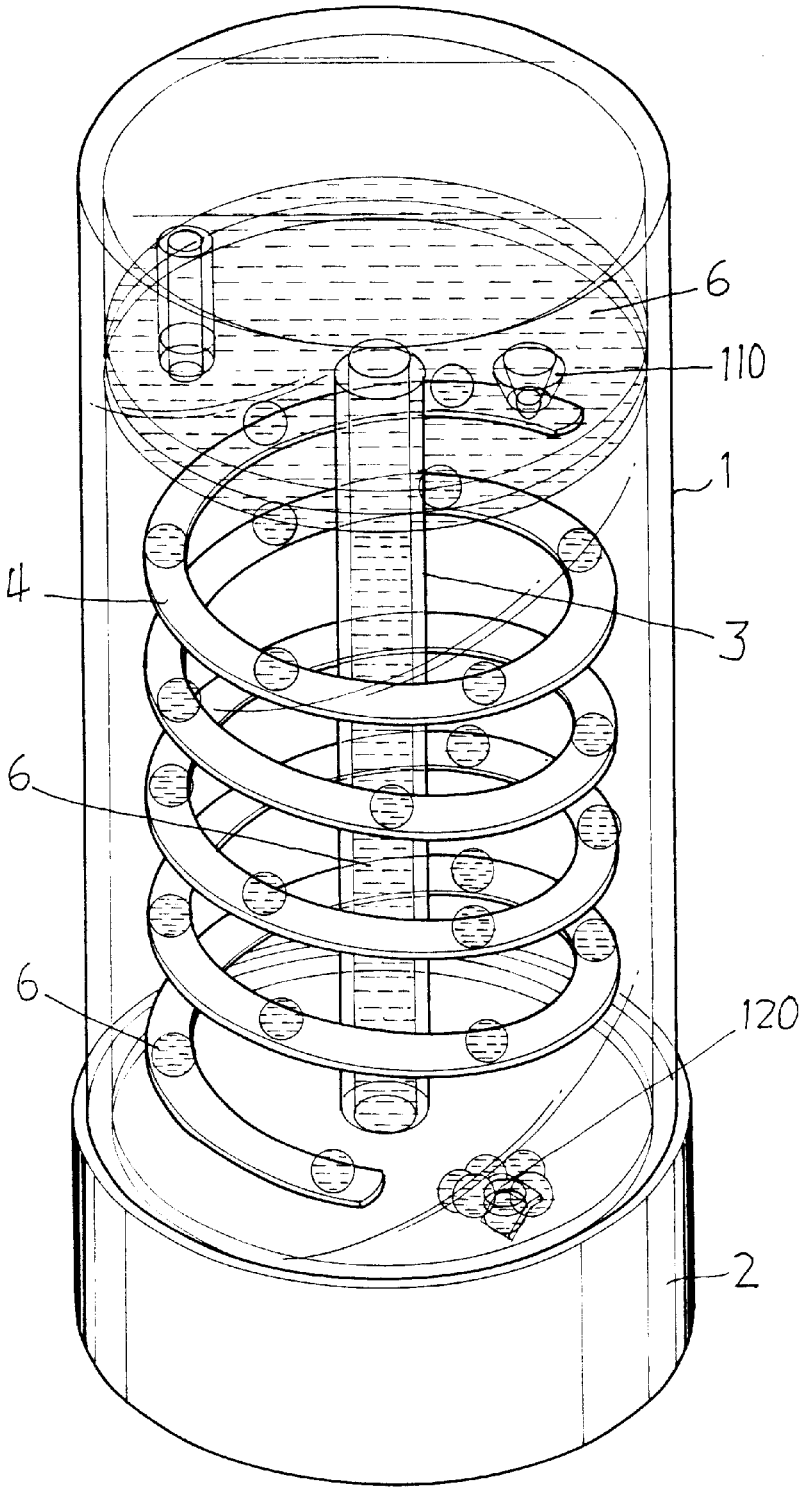
FIG. 3 is a perspective of the ornamental liquid container of FIG. 1.

When the cam 8 is brought by the driving means 9 to rotate and therefore reciprocate between upper and lower dead points in its moving travel, the cam 8 intermittently pats the diaphragm 7, causing the diaphragm 7 to locally move upward and downward in reciprocating action. When the diaphragm 7 is locally pushed upward, it compresses the bottom chamber 13 and produces a compressive pressure in the bottom chamber 13 to push the colored water 6 in the bottom chamber 13 upward into the hollow tube 3, as shown in FIGS. 2 and 3, and flow into the top chamber 11 via a top opening of the hollow tube 3. Colored water 6 flown into the top chamber 11 continuously drips down into the middle chamber 12 via the first hole 110 provided at the partition plate between the top and the middle chambers 11, 12. Drips of the colored water 6 fall onto and roll down along the water dispensing member 4 one by one to pass through the middle chamber 12 and create dynamic views in the housing 1. When the drips 6 reach an end of the water dispensing member 4, they sequentially move down into the bottom chamber 13 via the second hole 120 provided at the partition plate between the middle and the bottom chambers 12, 13 to complete one cycle of moving travel of the colored water 6 in the housing 1. When the cam 8 is kept rotating, the colored water drips 6 are continuously formed to circulate in the housing 1 and therefore create dynamic and interesting views in the housing 1, making the liquid container a very good ornament.

Figure 4:
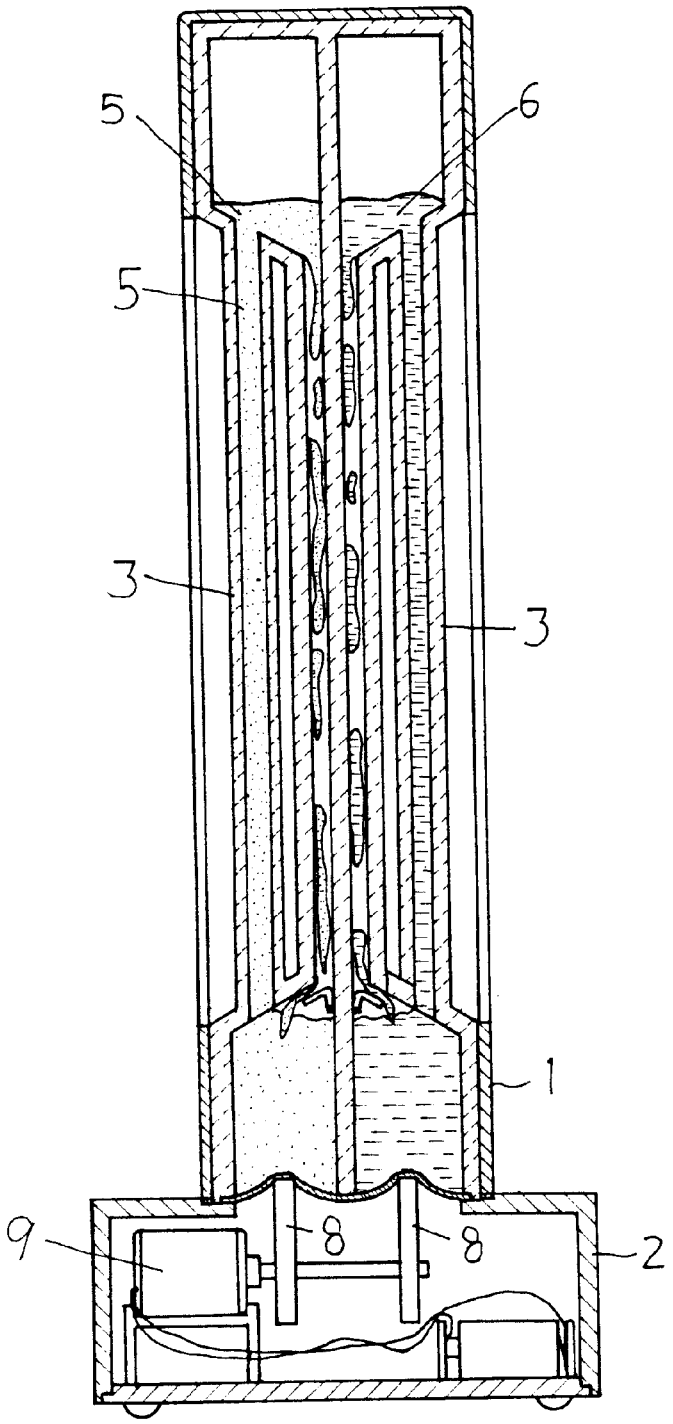
FIG. 4 is a side sectional view of an ornamental liquid container according to another embodiment of the present invention, wherein a dual-space housing is provided.
Figure 5:
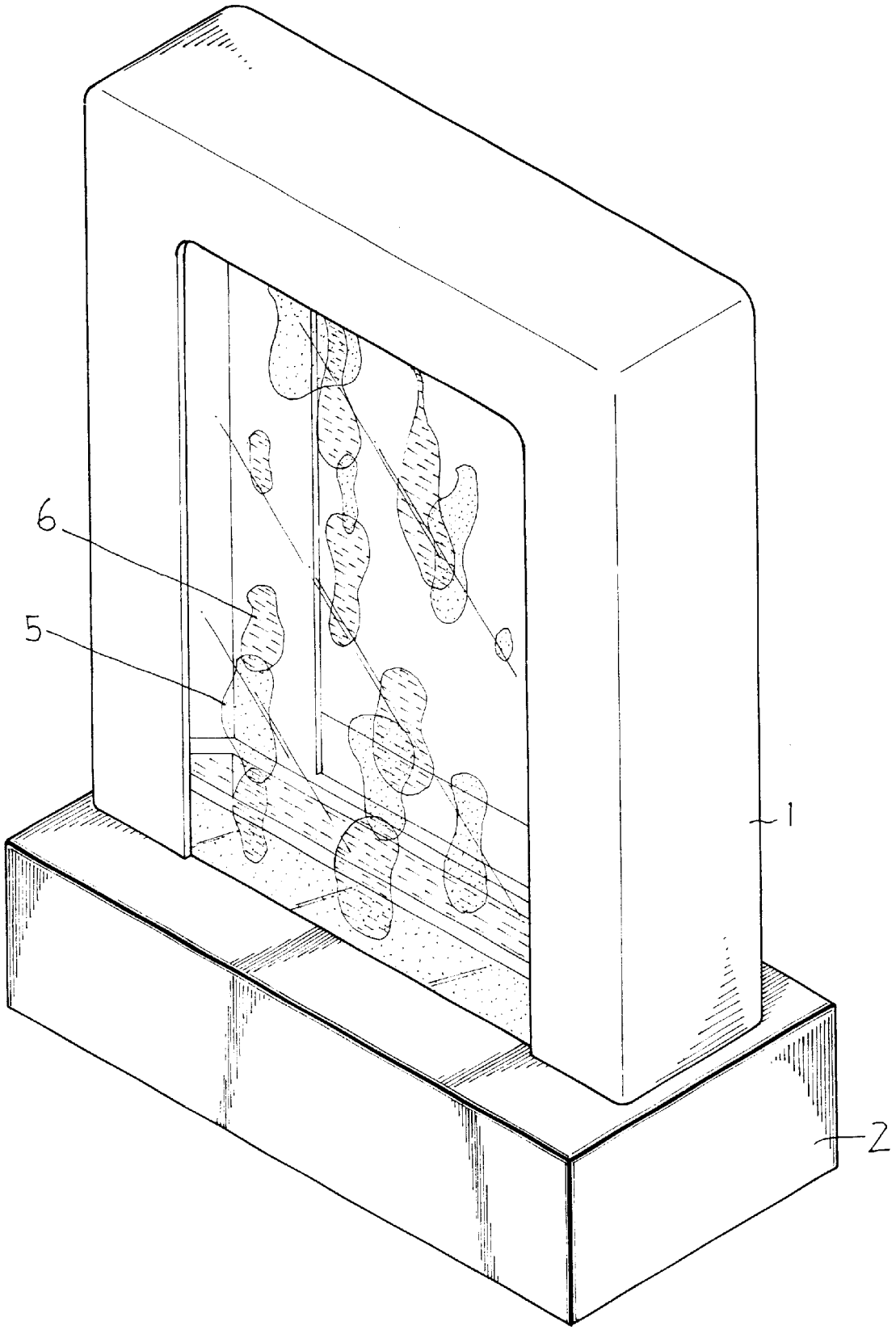
FIG. 5 is a perspective of the ornamental liquid container of FIG. 4.
Figure 6:
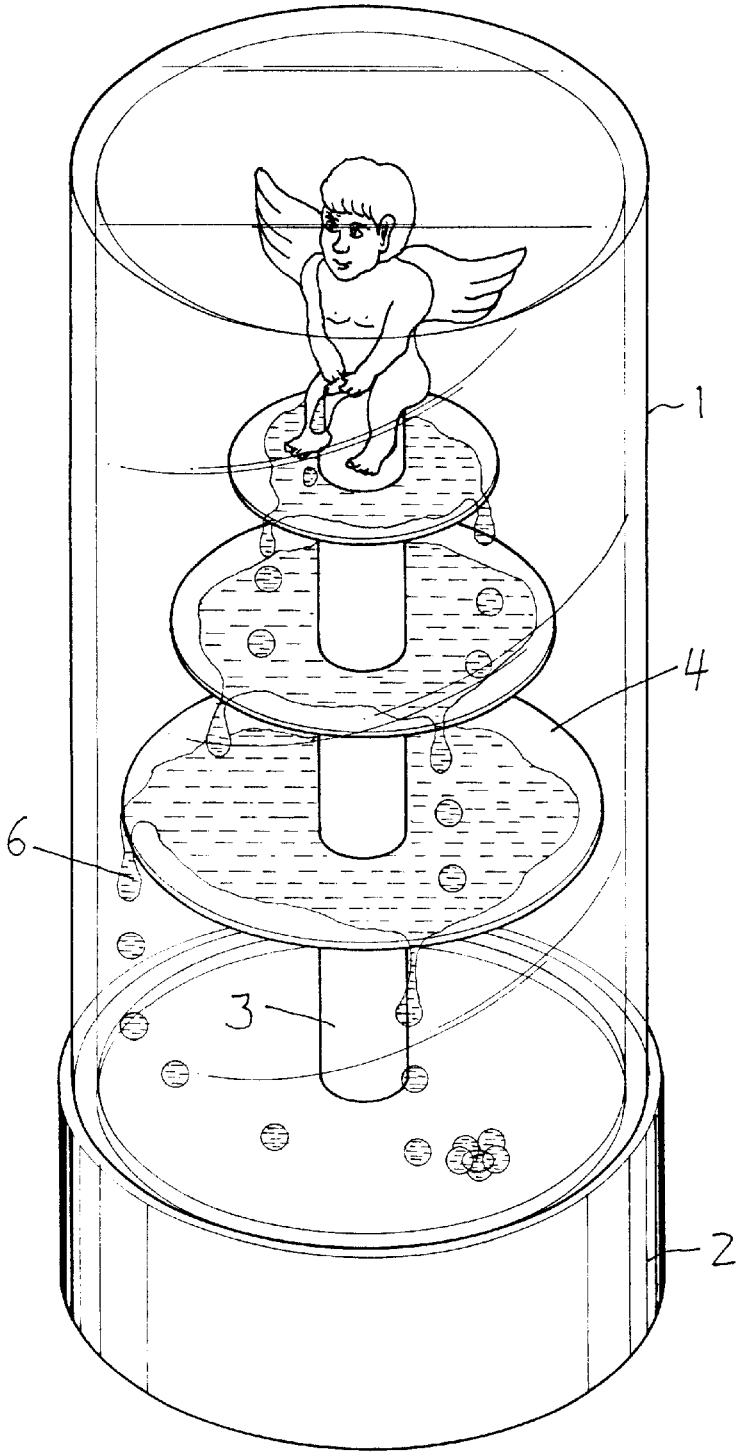
FIG. 6 is a perspective of a further embodiment of the present invention.

In another embodiment of the present invention as shown in FIGS. 4 and 5, the hollow housing 1 provides two separated spaces that overlap each other. Both the two spaces in the hollow housing 1 are structurally similar to the hollow housing 1 in the first embodiment of FIG. 1. Further, the water dispensing member 4 around the hollow tube 3 may be differently designed. In a further embodiment of the present invention as shown in FIG. 6, the water dispensing member 4 includes more than one plane located at different levels to allow water drips 6 to accumulate therein and gradually drip down therefrom. In brief, with the same driving principle, the ornamental liquid container of the present invention may have different appearances and create dynamic views in different ways.

What is claimed is:

1. An ornamental liquid container for creating dynamic views, comprising a hollow housing and a base having an open top; said hollow housing being divided into a top, a middle, and a bottom chamber, said bottom chamber having an open bottom and connected at a lower end to said open top of said base with a diaphragm made of elastic and soft material connected to and between said bottom chamber and said base in a watertight manner; and said base defining an inner space in which a driving means and a cam connected to and driven by said driving means are mounted therein closely below said elastic and soft diaphragm.

2. An ornamental liquid container for creating dynamic views as claimed in claim 1, wherein said hollow housing is provided with a hollow tube that extends through said middle chamber to locate between and communicate said top and said bottom chambers.

3. An ornamental liquid container for creating dynamic views as claimed in claim 1, wherein said cam mounted in said base below said elastic and soft diaphragm, when being driven to rotate by said driving means and enter an upper dead point in its moving travel, contacts with said diaphragm and causes said diaphragm to locally project into said bottom chamber of said housing.

* * * * *